United States Patent [19]

Graiff et al.

[11] 4,389,221

[45] Jun. 21, 1983

[54] GASOLINE COMPOSITION AND METHOD FOR REDUCING FUEL CONSUMPTION

[75] Inventors: Leonard B. Graiff, Houston, Tex.; Rudolf F. Heldeweg; Corrie M. J. Leenaars, both of Amsterdam, Netherlands

[73] Assignee: Shell Oil Company, Houston, Tex.

[21] Appl. No.: 401,192

[22] Filed: Jul. 23, 1982

[51] Int. Cl.[3] ..... C10L 1/24

[52] U.S. Cl. ..... 44/66; 44/70; 44/76

[58] Field of Search ..... 44/76, 70, 66

[56] References Cited

U.S. PATENT DOCUMENTS 3,882,031 5/1975 Askew et al. ..... 252/47

4,236,898 12/1980 Davis et al. ..... 44/66

*Primary Examiner*—Charles F. Warren

*Assistant Examiner*—Y. Harris-Smith

[57] ABSTRACT

A gasoline motor fuel composition is disclosed comprising a minor and effective amount of at least one sulfurized dioleyl ester of norbornene. Also disclosed is a method for reducing fuel consumption of internal combustion engines by incorporating a sulfurized dioleyl ester of norbornene into the gasoline fuel to said engines and operating the engines for a time sufficient to disperse said ester throughout the oil-contacted surfaces of the engine.

10 Claims, No Drawings

GASOLINE COMPOSITION AND METHOD FOR REDUCING FUEL CONSUMPTION

BACKGROUND OF THE INVENTION

This invention relates to motor fuel compositions for use in internal combustion engines, and more particularly to gasoline compositions and a method for reducing fuel consumption by using said gasoline as fuel for the engines.

The trend today in the design of new internal combustion engines, and particularly those engines employed for vehicular transportation, is toward increasing fuel economy to conserve rapidly depleting hydrocarbon resources. Also there is great need for improved gasolines which can further reduce fuel consumption of existing engines, and particularly spark-ignition internal combustion engines.

Recent fuel cost increases have changed engine cost/benefit design guidelines and, therefore, renewed interest in engine friction reduction. At a typical part throttle engine operating condition, the mechanical friction (including oil pump and water pump) of a conventional four-cylinder engine consumes approximately 22% of the indicated power. A 1 psi (6.9 kPa) MEP reduction in mechanical friction can result in an EPA, M-H fuel economy improvement of 1%–2%, depending on the engine/vehicle configuration.

Reducing engine friction must be accomplished without adversely affecting other important properties of the crankcase oil such as detergency, antiwear and load-carrying properties. The present invention is concerned with the development of energy-saving gasoline fuel additives which reduce fuel consumption without adversely affecting other oil properties.

A gasoline composition and method of reducing fuel consumption of an internal combustion engine utilizing a minor friction-reducing amount of a sulfurized fatty acid amide, ester or ester-amide of an oxyalkylated amine are described in U.S. Pat. No. 4,236,898.

A lubricating composition and a method of preparing oil soluble sulfurized norbornenyl compounds for use in lubricating oil as anti-oxidants or load carrying agents are disclosed in U.S. Pat. No. 3,882,031, which is incorporated herein by reference.

SUMMARY OF THE INVENTION

An improved motor fuel composition is disclosed comprising a major amount of a liquid petroleum motor fuel boiling in the gasoline range and a minor and effective amount of at least one sulfurized dioleyl ester of norbornene sufficient to reduce fuel consumption of an internal combustion engine employing said motor fuel, said sulfurized dioleyl ester having the general formula:

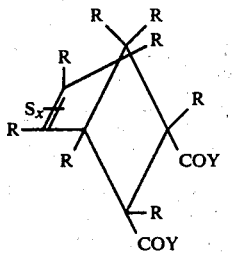

wherein each R is independently selected from the group consisting of hydrogen and lower alkyl, with the provision that no more than two R's per molecule are lower alkyl, X is an integer from 1 to 8, and each Y contains up to about twenty-two carbon atoms and is independently selected from the group consisting of hydrocarbon-based oxy radicals and the oxy-residue of a polyhydric alcohol. Preferably, at least one Y is the oxy-residue of oleyl alcohol.

Also disclosed is a method for reducing fuel consumption of internal combustion engines by incorporating a sulfurized dioleyl ester of norbornene into the gasoline fuel to said engines and operating the engines for a time sufficient to disperse said ester throughout the oil-contacted surfaces of the engine.

DESCRIPTION OF PREFERRED EMBODIMENTS

The sulfurized dioleyl esters of norbornene are known to be useful as anti-oxidant and load-carrying agents in lubricating oil. Methods of preparing these compounds are described in U.S. Pat. No. 3,882,031.

Surprisingly, when these compounds are incorporated into the gasoline fuel to the engine, they are also effective in reducing the fuel consumption of internal combustion engines.

The incorporation of polymers and viscous oils in gasoline formulations to improve inlet system cleanliness and to maintain PCV systems in proper operating condition is known. Studies have shown that a major portion of these relatively non-volatile polymers and viscous oils is trapped in the engine crankcase lubricating oil. Most likely the sulfurized dioleyl esters of norbornene of the invention, which are contained in the gasoline, are trapped in the lubricating oil and act as friction reducing agents. In fact, these agents improve fuel efficiency when added directly to the crankcase lubricating oil, as demonstrated in Example II, herein.

The formula for the additives of the invention may be expressed

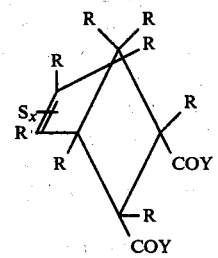

wherein each R is independently selected from the group consisting of hydrogen and lower alkyl, with the provision that no more than two R's per molecule are lower alkyl, X is an integer from 1 to 8 and each Y contains up to about twenty-two carbon atoms and is independently selected from the group consisting of hydrocarbon-based oxy radicals and the oxy-residue of a polyhydric alcohol. Preferably R will be hydrogen and Y will be either a hydrocarbon-based oxy radical or any oxy residue of a polyhydric alcohol.

It is especially preferred that at least one Y is the oxy-residue of oleyl alcohol. A particularly preferred compound is the sulfurized ester of 5-norbornene-2,3-di(1-octadecyl) dicarboxylate.

The amount of sulfurized norbornene ester in the gasoline should be effective to reduce fuel consumption.

Generally, the range will be from about 5 ppmw to about 1000 ppmw. We have found that from 30–300 ppmw is generally suitable.

The invention also includes a method for reducing fuel consumption of an internal combustion engine by incorporating an effective amount of the sulfurized esters of norbornene of the invention into the gasoline fuel to said engine, and operating the engine on a sufficient quantity of the treated fuel to disperse the sulfurized esters throughout the oil-contacted surfaces of the engine. This may require from about 20 to 100 gallons of treated fuels but will generally be accomplished with about 40 gallons, depending on the treatment level.

The invention is now illustrated with the aid of the following examples, which are intended to be a complete specific embodiment of the invention and are not intended to be regarded as a limitation thereof.

EXAMPLE I

A typical sample of sulfurized 5-norbornene-2,3-dioleyldicarboxylate (herein Additive A) is prepared as follows:

A. Starting material is the diels-alder product of cyclopentadiene and maleic anhydride; 5-norbornene-2,3-dicarboxylic acid anhydride.

B. Esterification—Place 32.8 g (0.20 Mol) of the anydride, 107.4 g (0.40 Mol) of oleylalcohol, 135 ml. of toluene and 100 mg of p-toluene-sulfonic acid (other acid catalysts like sulfuric acid can also be used) in a 500 ml round-bottomed flask and attach a short fractionating column connected to a downward condenser. Reflux the mixture gently until no more reaction water can be distilled off. Then allow the reaction mixture to cool the ambient temperature and subsequently pour it into an excess of water; separate the organic layer; wash it first with saturated sodium bicarbonate solution and then with water; and dry it with anhydrous magnesium sulphate. Remove the toluene via distillation under reduced pressure and collect the diester (131.2 g: 0.19 mol: yield 95%).

C. Sulfurization—In a 500 ml. round-bottomed flask, equipped with a mechanical stirrer, 136.6 g (0.20 Mol) of diester (from step B), 25.6 g of elemental sulfur and 100 mg hydroquinone (or other inhibitors well-known in the art) were allowed to react under a blanket of nitrogen at 140–150 Deg.C. for 5 hours. The mixture is then filtered under suction to remove residual sulfur: yield of sulfurized diester is 140 g.

EXAMPLE II

A 1979 Buick 231 CID-2V V-6 engine with automatic transmission was used to study the effectiveness of Additive A as a crankcase lubricating oil additive in improving engine fuel economy. The engine was mounted on a dynamometer stand equipped with flywheels to simulate the inertia of a car. "Mileage" was accumulated on the engine using a commercial unleaded type gasoline and a 10W40 multi-grade motor oil.

A cycle consisting of an idle mode and 35 and 65 mph cruise modes with attendant accelerations and decelerations was used to accumulate mileage. Fuel consumption was measured at 30, 35, 45, 55, and 65 mph equivalent level-road-load speeds by a computer, recording the loss in weight of a can of fuel on an electronic balance. Readings were recorded by the computer every minute for ten minutes (to allow fuel flow variations to be detected during the test). During fuel consumption tests (and also during most of the cyclic operation of the engine), the jacket water temperature out was maintained at 95° C. (203° F.) and the carburetor air at 45° C. (113° F.), with constant humidity. The sump oil temperature, which was allowed to equilibrate at each speed, ranged from about 109° C. (230° F.) at 30 mph to 130° C. (266° F.) at 65 mph.

The test with Additive A started after this engine had accumulated the equivalent of at least 15,000 miles to reduce the effect of normally increased fuel economy typically obtained during the "break in" period of an engine. After the motor oil was drained and the filter changed, the engine was flushed once with fresh motor oil and then refilled with fresh motor oil. The engine was then operated on the above cycle for about 50 hours (about 1800 equivalent miles). At this time, fuel consumption measurements were taken and recorded. Additive A was then added directly to the engine oil via the oil filler opening in an amount sufficient to give 0.3% by weight in the oil. The engine was operated on the cycle for about four hours to allow mixing and circulation of the additive and oil, after which fuel consumption measurements were again taken and recorded. Results of these tests are shown in Table A.

TABLE A

EFFECT OF ADDITIVE A IN MOTOR OIL ON FUEL ECONOMY

| | Car speed, mph | | | | |
|---|---|---|---|---|---|
| Fuel Consumption, g/mile | 65 | 55 | 45 | 35 | 30 |
| Before additive treatment | 139.23 | 106.22 | 79.18 | 55.63 | 45.47 |
| After additive treatment | 138.83 | 106.13 | 78.73 | 54.97 | 44.66 |
| % Reduction | 0.3 | 0.1 | 0.6 | 1.2 | 1.8 |

EXAMPLE III

The following hypothetical example is based on our observation that an internal combustion engine lubricating oil additive which improves mileage is also effective if added to the fuel to said engine. Similar tests run on other fuel economy lubricating oil additives lead us to believe that if these tests were actually performed with Additive A the results would be approximately as indicated.

A 1978 Ford 302-CID 2V engine with an automatic transmission is used in the study. The engine is mounted on a dynamometer stand equipped with flywheels to simulate the inertia of a car. "Mileage" is accumulated on the engine using a commercial unleaded-type gasoline and a 20/20W motor oil.

The engine operating cycle and conditions are the same as those for Example II. The test with Additive A commences after this engine is fully "broken-in"; that is, after it has operated for over 400 hours. As shown in Table B, the fuel consumption of the engine decreases about 0.85% on average[a] (over the speeds investigated) after it is operated on about 35 gallons of gasoline containing 300 ppm Additive A. The improvement ranges from about 0.2% at 65 mph to about 1.8% at 30 mph.[b]

a.Average fuel consumption changes below 0.25% are considered not to be significant (established from repeat tests on the base fuel).

b.Results obtained by others have also indicated tha fraction reducing additives show improved fuel economy benefits at low engine speeds, probably because engine lubrication approaches boundary layer conditions as the speed is reduced.

The engine is then run on the base fuel (without additive) for six hours—about 14 gallons of fuel. The average fuel consumption at the end of this time shows no change from the previous test (see Run 3 in Table B).

These results indicate that the additive is functioning via the crankcase lubricant; that is, it is not an immediate fuel effect. (Calculations show that if only 30% of the Additive A in the 35 gallons of gasoline reach the crankcase oil it would contain about 0.2%w—a quantity which is known to be beneficial).

TABLE B

| Run No. | Fuel | Engine Hours | Eng. Hrs. Since Oil Change | Fuel Consumption, g/mile Speed, mph 65 | 55 | 45 | 35 | 30 | Avg. |
|---|---|---|---|---|---|---|---|---|---|
| 1 | Base[a] | 429 | 68 | 153.37 | 124.93 | 110.96 | 103.71 | 104.24 | 119.44 |
| 2 | Base + Additive[b] | 451 | 90 | 153.05 | 123.67 | 110.16 | 102.89 | 102.40 | 118.43 |
| | % change[c] | — | — | −0.19 | −1.01 | −0.72 | −0.79 | −1.77 | −0.85 |
| 3 | Base[d] | 458 | 97 | 153.38 | 123.40 | 109.31 | 103.01 | 102.46 | 118.31 |
| | % change[c] | — | — | 0.21 | −0.22 | −0.77 | 0.12 | 0.06 | −0.10 |
| 4 | Base[e] | 460 | 1 | 154.88 | 125.30 | 112.49 | 104.98 | 105.50 | 120.63 |
| | % change[c] | — | — | 0.98 | 1.54 | 2.91 | 1.91 | 2.97 | 1.96 |

[a]A commercial unleaded-type gasoline
[b]After engine operated on base fuel + 300 ppm Additive A for 15 hours (~500 miles and 35 gallons of fuel).
[c]Relative to preceding fuel consumption tests.
[d]After engine operated on base fuel for 6 hours (~200 miles and 14 gallons of fuel)
[d]After fresh oil change The next step in the test is to determine the effect on fuel consumption of draining the crankcase oil and refilling with new crankcase lubricating oil. As shown by Run 4 in Table B, this increases the average fuel consumption by about 2%. One would expect the consumption to increase by only 0.85% (i.e., loss of the beneficial effect of Additive A—see Run 2 in Table B); however, it has been found in earlier studies in this engine that fuel consumption increases about 1% immediately after an oil change. Hence, the combined expected effect (0.85% for Additive A and 1% for the oil change) is about that observed (1.96%—see Run 4).

What is claimed is:

1. An improved motor fuel composition comprising a major amount of a liquid petroleum motor fuel boiling in the gasoline range and a minor and effective amount of at least one sulfurized dioleyl ester of norbornene sufficient to reduce fuel consumption of an internal combustion engine employing said motor fuel, said sulfurized dioleyl ester having the general formula:

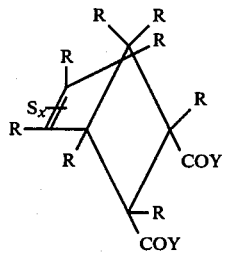

wherein each R is independently selected from the group consisting of hydrogen and lower alkyl, with the provision that no more than two R's per molecule are lower alkyl, X is an integer from 1 to 8 and each Y contains up to about twenty-two carbon atoms and is independently selected from the group consisting of hydrocarbon-based oxy radicals and the oxy-residue of a polyhydric alcohol.

2. The motor fuel composition of claim 1 wherein Y is a hydrocarbon-based oxy radical.

3. The motor fuel composition of claim 2 wherein R is hydrogen.

4. The motor fuel composition of claim 1 wherein Y is an oxy residue of a polyhydric alcohol.

5. The motor fuel composition of claim 4 wherein R is hydrogen.

6. The motor fuel composition of claim 1 wherein at least one Y is the oxy-residue of oleyl alcohol.

7. The motor fuel composition of claim 1 wherein the sulfurized dioleyl ester of norbornene is sulfurized 5-norbornene 2,3-di(1-octadecyl) dicarboxylate.

8. The motor fuel composition of claim 7 wherein the effective amount of sulfurized dioleyl ester of norbornene in gasoline is from about 5 ppm to about 1000 ppm by weight of the said motor fuel composition.

9. A method for reducing the fuel consumption of internal combustion engines which comprises incorporating into the gasoline fuel of said engine an effective amount of at least one sulfurized dioleyl ester of norbornene sufficient to reduce fuel consumption of said engine, and operating said engine for a time sufficient to disperse said sulfurized norbornene ester throughout the oil-contacted surfaces of said engine, said sulfurized norbornene ester having the general formula:

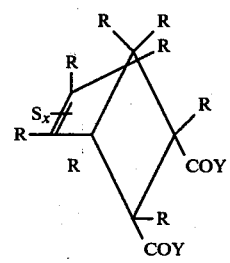

wherein each R is independently selected from the group consisting of hydrogen and lower alkyl, with the provision that no more than two R's per molecule are lower alkyl, X is an integer from 1 to 8 and each Y contains up to about twenty-two carbon atoms and is independently selected from the group consisting of hydrocarbon-based oxy radicals and the oxy-residue of a oleyl alcohol.

10. The method of claim 9 wherein the sulfurized dioleyl ester of norbornene is sulfurized 5-norbornene 2,3-di(1-octadecyl) dicarboxylate.

* * * * *